United States Patent [19]

Bricmont

[11] 4,290,752

[45] Sep. 22, 1981

[54] WALKING BEAM FURNACE

[75] Inventor: Francis H. Bricmont, Pittsburgh, Pa.

[73] Assignee: Bricmont & Associates, Inc., McMurray, Pa.

[21] Appl. No.: 175,303

[22] Filed: Aug. 4, 1980

[51] Int. Cl.[3] ..... F27D 3/00; F27B 9/14

[52] U.S. Cl. ..... 432/235; 432/122

[58] Field of Search ..... 432/122, 235; 198/774, 198/775

[56] References Cited

U.S. PATENT DOCUMENTS 3,450,394 6/1969 Wilde et al. ..... 432/122

3,544,094 12/1970 Knaak ..... 432/122

FOREIGN PATENT DOCUMENTS 1413171 11/1975 United Kingdom ..... 432/122

*Primary Examiner*—John J. Camby

*Attorney, Agent, or Firm*—Thomas H. Murray; Clifford A. Poff

[57] ABSTRACT

Walking beam assemblies used to advance workpieces in a reheat furnace include upper and lower runs of coolant pipes spaced and joined together by web plates to extend along each of the opposite lateral sides of a body of refractory that contacts the workpieces. The web plates support clip members that have a bent mid-portion to wrap around the upper run of the coolant pipe. A leg section of each clip member extends along the side of the refractory material to an elevation spaced below the workpiece-engaging face of the refractory. Support members including gusset plates are carried by the refractory support member to engage the lower run of the coolant pipe and extend along the web plates for support.

11 Claims, 3 Drawing Figures

WALKING BEAM FURNACE

BACKGROUND OF THE INVENTION

This invention relates to a walking beam furnace for heating workpieces while advanced through the furnace by walking beam assemblies having a body of refractory and a cooling system including pipes at opposite lateral sides of the body of refractory below the workpiece-engaging face thereof. More particularly, the present invention relates to an improved construction and relationship of parts to support and cool a body of refractory material without rupture or failure to the integrity of the cooling system.

It is well known in the art to reheat ingots, blooms, slabs, billets and similar workpieces in a walking beam type furnace for subsequent processing in a rolling mill. The workpieces are delivered in succession by a suitable conveyor system into the chamber of the furnace having burners arranged to heat each workpiece up to a desired temperature before it is discharged onto a furnace-delivery table. The workpieces are advanced in the furnace chamber with step-by-step movements by walking beam assemblies that form stationary and movable supports for the workpieces. The movable supports first lift the workpieces from the stationary supports and then advance by movement toward the exit end of the furnace through a predetermined distance. The movable supports are then lowered to deposit the workpieces on the stationary members for support thereby. The movable supports are then retracted while spaced below the bottom surface of the workpieces to a starting position for a succeeding cycle to lift and advance the workpieces. Usually, two or more lifting beam assemblies extend in the direction of the length of the furnace chamber along the lateral sides of the stationary support to collectively form the walking beam assemblies. Heat insulating material, such as refractory, is usually provided in the furnace on the various surfaces along the hearth that contact and support the workpieces during movement within the furnace chamber. Such material is used to at least minimize, if not eliminate, the development of cold spots in the workpieces at the points of contact with the supporting surface of the walking beam assemblies. The heat insulating material, usually comprised of hightemperature refractory, must include a support having coolant facilities to restrain movement and prevent overheating.

In the past, a water-cooled channel was used to retain the hearth refractory and support the load imposed on the refractory by the workpieces as shown, for example, in U.S. Pat. No. 3,450,394. The water-cooled channel is comprised of a carbon steel weldment consisting of a plate section welded along its side edges to the end flanges of a channel section. The hollow area thus formed in the channel with the end plate is coupled to water-supply and discharge pipes. The opposite ends of the weldment are closed by end plates that are welded in place. The water-cooled channel is arranged on the support for the refractory such that the elongated enclosed water channel is orientated vertically on the refractory support and embedded in the side edge of the refractory. An L-shaped clip, in cross section, made of alloy material has one leg section welded to the top edge of the water-cooled channel such that the free leg section of the clip extends vertically along the outer side edge of the refractory for support of the refractory as well as cooling by conductive heat transfer.

The water-cooled channel and support-clip arrangement have been plagued with problems. Water leaks occur at weld failures due to differential cooling to the weldment forming the coolant channel. The leakage of coolant water cannot be tolerated in a furnace of this type for heating workpieces. Moreover, the upstanding leg of the alloy clip that extends along the side edge of the refractory curls outwardly away from the refractory because of differential heating/cooling, thus rendering it useless for its intended use for support of the refractory. Moreover, welding of the alloy clip to the carbon steel forming the water-cooled channel is a difficult undertaking because of the need to weld widely different metals. It is absolutely essential that the workpieces undergo heating in the furnace without any contact with the water-cooled channel and the refractory support clip which are cooled by conductive heat transfer. It has been found that the thermal stresses which develop in the weldment are a predominant cause leading to weld failures that permit water to leak from the coolant channel. It has also been found that sharp edges and corners in the known cooling channel arrangement promote scale and dirt accumulations that adversely affect the operation of the walking beams. In particular, the outward curling of the clip provides an open cavity into which scale can accumulate and possibly even extend up along the refractory into heat conductive transfer with a workpiece which, of course, cannot be tolerated. The necessary support for the refractory is reduced or ineffective when its clip curls outwardly.

SUMMARY OF THE INVENTION

It is an object of the present invention to provide an improved construction and arrangement of parts for a walking beam assembly including the provision of a more efficient and trouble-free cooling system for a body of refractory forming part of the assemblies to engage a workpiece while undergoing heating in a walking beam furnace.

It is a further object of the present invention to provide an improved coolant system for a walking beam assembly in a walking beam furnace wherein an upper run of water-cooled seamless tubing is welded to a spacer plate which is, in turn, welded to a lower run of water-cooled seamless tubing in a manner such that the integrity of the coolant tubing is not compromised by welding, particularly by the need to use weld metal to form any part of the watercontainment chamber.

It is a further object of the present invention to provide in a furnace to heat workpieces, an improved walking beam assembly having workpieces engaging a body of refractory supported by water-cooled assemblies that include clip members attached to a water-cooled arrangement of seamless tubing for conductive heat transfer to bring about the thermal stability to the clip while extending along the side edge of the body of refractory material.

More particularly, according to the present invention there is provided in a walking beam furnace having walls forming a passageway for workpieces of the type wherein the hearth includes stationary and movable walking beam assemblies to support and advance the workpieces along the passageway, the combination wherein the walking beam assemblies include a body of refractory having a workpiece-engaging face, a support to carry the body of refractory, upper and lower runs of coolant pipes, means to join together the upper and lower runs of coolant pipes at each of the opposite lateral sides of the body of refractory below the workpiece-engaging face thereof, and clip means carried below the upper run of the coolant pipes to extend upwardly to a point spaced below the workpiece-engaging face of the body of refractory for cooling and lateral support thereof.

Such walking beam assemblies preferably include attachment members connected to the lower run of the coolant pipe for anchoring to the support used to carry the body of refractory. Upstanding gusset plates are arranged at spacedapart locations along at least the lower run of the coolant pipe to extend into the body of refractory and web plates are welded to the walls of the upper and lower runs of the coolant pipe for support thereof. It is preferred to employ a threaded fastener to adjoin the aforesaid web plate means to the clip members which preferably take the form of metal castings. The movable walking beam assembly preferably includes a refractory carrier in the form of channel sections that are orientated so that the toes extend downwardly and the webs of one channel section engage the webs of abutting channel sections. The channels extend transversely to the length of the body of refractory for support therefor with a corrugated-like undersurface having improved cooling characteristics.

These features and advantages of the present invention as well as others will be more fully understood when the following description of the preferred embodiment is read in light of the accompanying drawings, in which.

Figure 1:
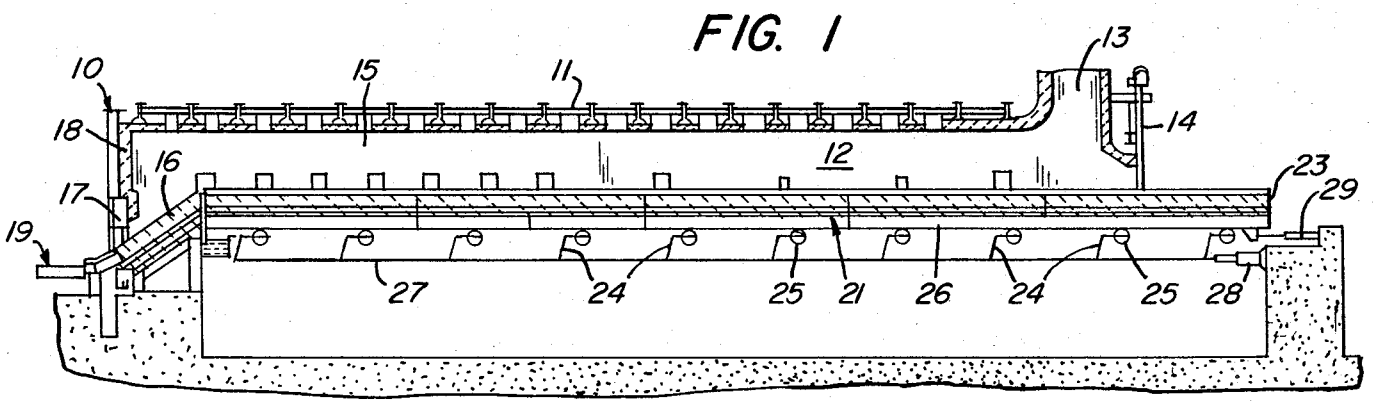
FIG. 1 is a longitudinal section through a walking beam furnace for heating workpieces incident to a rolling operation and having walking beam assemblies embodying the features of the present invention.

In FIG. 1, reference numeral 10 identifies a furnace of one general type which is suitable for heating workpieces such as slabs for a subsequent rolling operation. It is to be understood, however, that walking beam assemblies embodying the features of the present invention can be employed with equal success to advance workpieces along the heating chamber of a furnace embodying any one of a number of different construction characteristics. The furnace 10 in FIG. 1 includes a roof 11 having burners spaced therealong to deliver media for combustion into a furnace chamber 12 that communicates with a waste-gas flue 13 at the entry end of the furnace where a door 14 is open for the entrance of workpieces. The workpieces are delivered to the furnace by a conveyor, not shown. The furnace chamber 12 is enclosed by side walls 15 (only one shown) that extend to the discharge end where a downwardly-inclined chute 16 supports a workpiece while discharged from the furnace through a door 17 forming a closure for an opening in an end wall 18. A delivery table 19 transports the heated workpiece to a rolling mill for processing therein.

A hearth 21 includes walking beam assemblies to support and advance workpieces along the furnace chamber 12. The walking beam assemblies comprise at least two stationary assemblies 22 and one or more movable assemblies 23 with the latter being generally narrower and extending along within a space provided between two stationary assemblies. Usually, at least two movable and two stationary assemblies are provided in a furnace. When the distance between the side walls of the furnace is relatively large as is the case when reheating long slabs, three, four or more movable walking beam assemblies are required to adequately support and advance the slabs in the furnace.

An operating mechanism is provided for each movable walking beam assembly to lift, advance, lower and retract the assemblies which occur in unison relative to the stationary assemblies. Any one of numerous well-known forms of operating mechanism may be used for this purpose. In FIG. 1, one operating mechanism is shown schematically and comprises spaced-apart bell-crank arms 24, each carrying a roller 25 to engage a support beam 26 forming part of the movable walking beam assembly 23, as will be described in greater detail hereinafter. The crank arms are mounted for pivotal movement by bearing block supports at the underside of beam 26. The lower ends of the crank arms 25 are secured by pivot pins to an actuating rod 27 arranged in a generally parallel relation with the movable walking beam assembly 23 and substantially the entire length thereof. An actuator 28, preferably in the form of a piston and cylinder assembly, is coupled to the actuating rod 27 to pivot the crank arms in unison so that the rollers exert a force on the walking beam assembly sufficient to lift the workpieces supported thereon through a vertical distance where they extend above the workpiece-support surface of a stationary walking beam. An actuator 29, preferably in the form of a piston and cylinder assembly is coupled by a bracket to the support beam 26 to reciprocate the walking beam assembly 23 in the direction of its length. Workpieces are advanced in a step-by-step manner along the hearth in the heating furnace first by the operation of actuator 28 which forms a lifting cylinder to raise the movable walking beam assembly and the workpieces supported thereon above the stationary assemblies 22. Actuator 29 is then operated to advance the movable walking beam assembly in the direction of its length and carry with it the workpieces supported thereby. At the end of this advancing movement, the actuator 28 is again operated to lower the lifting beam and the workpiece supported thereby into contact with the stationary members 22. After the lifting beam is lowered below the bottom surface of the workpieces, actuator 29 is operated to retract the movable assembly to a position where it is again lifted into supporting contact with a workpiece for a succeeding cycle of advancing movement.

Figure 3:
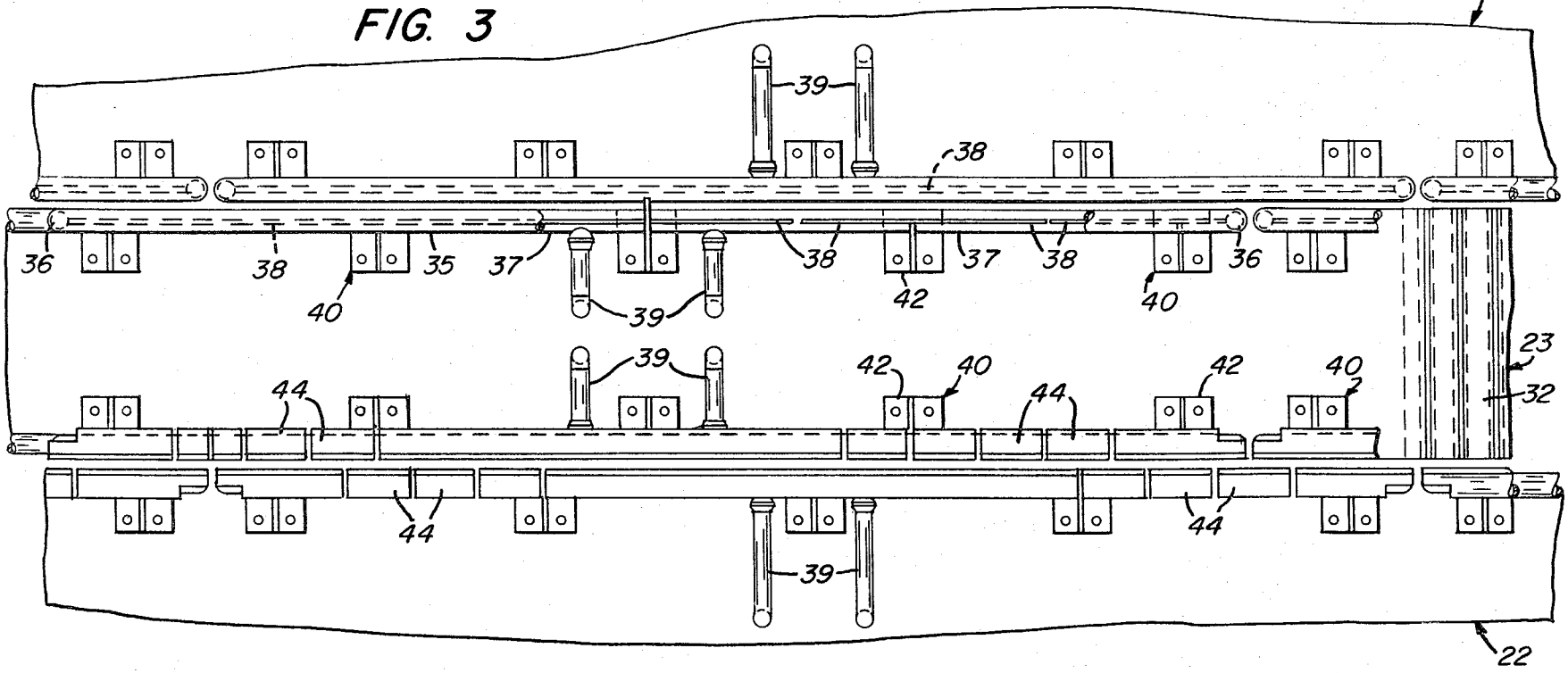
FIG. 3 is a sectional view taken along line III—III of FIG. 2.
Figure 2:
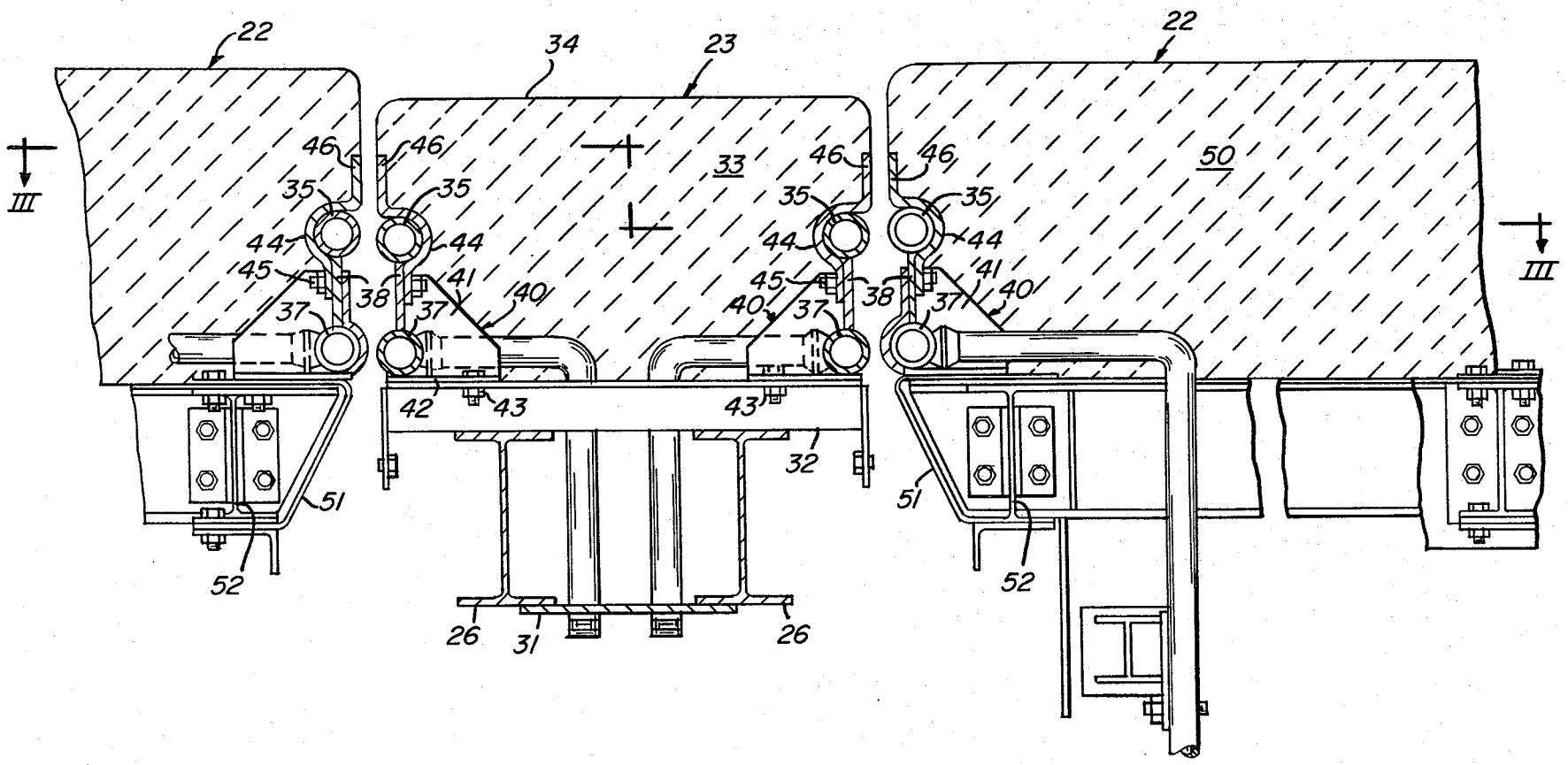
FIG. 2 is an elevational view, in section, of the walking beam assemblies incorporating the features of the present invention.

As shown in FIGS. 2 and 3, the preferred form of construction for the walking beam assemblies 22 and 23 is shown. Turning, first, to the movable walking beam assembly 23, the support beam 26 actually takes the form of two beam members arranged in a spaced-apart and parallel relation and held in place by a bottom plate 31 that forms a wear plate to engage the rollers of the lifting mechanism previously described. The beams 26 which extend along the length of the lifting beam assembly carry a bed comprised of channel members 32 arranged transversely to the extended length of the beams. The toes of the channels are attached by welds to the beams 26. Thus, the channels 32 of the bed are arranged side-by-side with the flanges at each side of one channel abutting with one flange of each of the adjacent channels. The corrugated-like undersurface of the bed promotes improved air-cooling. The bed carries a body of high-temperature refractory material 33 that is rammed or cast in place after the side supports and coolant facilities are installed on the bed. The top surface 34 of the body of refractory forms a workpiece-engaging surface that remains essentially free from contact with any metallic structure, particularly all water-cooled support structures, to eliminate the possible development of cold spots in the workpiece during heating in the furnace.

To prevent overheating and provide lateral support for the body of refractory, the present invention provides a novel arrangement of coolant pipes extending along each of the lower lateral sides of the body of refractory. There is actually a succession of similarly-constructed coolant systems arranged end-to-end along the entire length of the movable walking beam. Each coolant system includes a length of tubing, preferably comprised of seamless steel, that is bent to form an upper run 35 connected by vertical end portions 36 to a lower run 37. The lower run is not continuous along its length, but has blocking end caps attached to closely-spaced terminal ends of the tubing to prevent escapement of the coolant medium which is preferably water. Feed and delivery pipes 39 for the coolant are attached by weld metal to the side wall of the pipes at points closely adjacent the terminal ends of the tubing forming the lower run. This arrangement of parts is best shown in FIG. 3. The upper and lower runs of the coolant pipe are held in spaced-apart relation by a vertical arrangement of web plates 38. These web plates are welded along their opposite longitudinal sides to the runs of the coolant pipes with the ends of the adjacent web plates being spaced apart to form a gap therebetween. A plurality of support bracket assemblies 40 is positioned at spaced-apart locations along the coolant pipe for attached support to the bed of channel members 32. Each support bracket assembly includes an upstanding gusset plate 41 joined with a base plate 42 that includes a projected edge portion upon which the lower run of the coolant pipe is supported and attached thereto by weld metal. The gusset plate 41 has a curved lower portion conforming to the outer wall configuration of the lower run of the coolant pipe and a vertical edge to extend along a web plate. The base plate 42 is attached by threaded fasteners 43 to a channel member 32. The web plates 38 carry a plurality of side-by-side, U-shaped clips 44 that are preferably made of a cast alloy metal. One leg of each clip is attached by threaded fasteners 45 to the web plate. The midportion of each clip has a body section that conforms to the outer peripheral shape of the upper run of the coolant pipe. As shown in FIG. 2, the clip wraps about the outer peripheral surface of the pipe so that a leg 46 projects upwardly to a point which is spaced by a distance of at least several inches below the workpiece-engaging face of the refractory. As shown in FIG. 3, the clip members are arranged in a generally side-by-side relation to form a succession of these plates that extends along the upper run of the coolant pipe. The feed and delivery pipes 39 for coolant, as shown in FIG. 2, extend toward the central portion of the support bed where a 90° bend directs the remaining length of pipe through openings in the support bed downwardly through the gap between the support beams 26 and thence through openings provided in plate 31. The terminal end portions of the feed and delivery pipes are joined with suitable conduits extending to water-supply and drain pipes.

Turning, now, to the stationary support beam 22, it can be seen that essentially the same construction and arrangement of parts are employed to form the support and coolant structure for the body of refractory material 50. The body of refractory material 50 differs from the body of refractory 33 only by the fact that width of the body 50 is substantially greater than the width of body 33. Moreover, the support bracket assemblies 40 are attached by fasteners 43 that are passed through openings in the edge of a bent side of plate 51 and into openings provided in a support beam 52. The support beam 52 forms part of a support structure for the stationary member 22. By employing the bent arrangement of coolant pipe consisting of seamless tubing, long runs of weld are not relied upon for the integrity of the cooling channel. The upper and lower runs of the coolant pipe essentially form the flanges of an I-beam structure with the spacer web forming the web section. Such a beam structure reduces deflections in the refractory. This increases refractory life by avoiding tension stresses in the refractory. The clip members 44 provide refractory support and cooling above the upper run of the coolant tubing. Such support is necessary for the refractory since the workpieces must be heated to a temperature as high as 2400° F. It is essential, however, that no water-cooled section contacts the workpiece during heating. The clips can be made of an alloy casting for meeting the service requirements and successfully used since they can be attached to a water-cooled support, i.e., web plates 38, without welding. Thus, the present invention eliminates a requirement for welding together members made of widely-dissimilar metals. Moreover, the clip made from an alloy casting will not curl outwardly away from the surface of the refractory at an area which it is intended to support. This eliminates pockets or sharp corners and the entire water-cooled support structure for the refractory is designed to eliminate corners that might otherwise form surfaces where scale and dirt can build up. The arrangement of coolant pipes in the refractory support reduces heat loss in the furnace. The pipes are effectively cooled by a reduced volume of water as compared with the volume of coolant water required in known forms of a channel section produced as a weldment.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In a walking beam furnace having walls and a hearth forming a passageway for workpieces, said hearth including stationary and movable walking beam assemblies to support and advance the workpieces along the passageway, the combination wherein said walking beam assemblies include a body of refractory having a workpiece-engaging face, a support to carry said body of refractory, upper and lower runs of coolant pipes, means to join together said pipes to extend along each of the opposite lateral sides of said body of refractory below the workpiece-engaging face thereof, and clip means carried below the upper run of said coolant pipes while supported thereby to extend upwardly to a point spaced below the workpiece-engaging face of said body of refractory for cooling and lateral support thereof.

2. The combination according to claim 1 further including attachment members connected to the lower run of said coolant pipes for attachment to said support.

3. The combination according to claim 1 further including upstanding gusset plates extending into said body of refractory from at least the lower run of said coolant pipes.

4. The combination according to claim 1 wherein said means to join together include a web.

5. The combination according to claim 4 wherein said web includes a web plate to space and join together upper and lower runs of coolant.

6. The combination according to claim 5 wherein said upper and lower runs of coolant pipes comprise a continuous length of seamless tubing, and wherein said web plate is welded to the walls of said seamless tubing forming the upper and lower runs of coolant pipes.

7. The combination according to claim 1 further including fastener means for adjoining said clip means to said means to join together said pipes, and wherein said clip means comprises a metal casting.

8. The combination according to claim 1 wherein the support for the movable walking beam assembly includes side-by-side carriers extending transversely to the extended length of said body of refractory, and beam members to support said carriers.

9. The combination according to claim 1 wherein said means to join together pipes includes a plurality of plate members arranged end-to-end and welded along opposite side edges to the upper and lower runs of coolant pipes.

10. The combination according to claim 1 wherein said clip means includes a plurality of castings having a U-shaped cross section to wrap partly about the outer surface of the upper run of said coolant pipe and extending upwardly thereabove along said side edge of said body of refractory.

11. The combination according to claim 1 wherein said upper and lower runs of coolant pipes include a plurality of bent lengths of tubing each forming a conduit for coolant.

* * * * *